US007765979B2

(12) United States Patent
Vermonet et al.

(10) Patent No.: US 7,765,979 B2
(45) Date of Patent: Aug. 3, 2010

(54) SYSTEM FOR CONTROLLING THE OPERATION OF A DIESEL ENGINE OF A MOTOR VEHICLE

(75) Inventors: Claire Vermonet, Lille (FR); Vincent Souchon, Paris (FR); Benjamin Desmarquet, Maisons Laffitte (FR); Guillaume Meissonnier, Landes le Gaulois (FR)

(73) Assignees: Peugeot Citroen Automobiles SA, Velizy Villacoublay (FR); Delphi Technologies Holdings Sarl, Bascharage (LU)

( * ) Notice: Subject to any disclaimer, the term of this patent is extended or adjusted under 35 U.S.C. 154(b) by 0 days.

(21) Appl. No.: 11/422,596

(22) Filed: Jun. 6, 2006

(65) Prior Publication Data

US 2006/0272612 A1 Dec. 7, 2006

(30) Foreign Application Priority Data

Jun. 7, 2005 (FR) ..... 05 05784

(51) Int. Cl.
*F02B 5/00* (2006.01)

(52) U.S. Cl. ..... 123/305; 123/300; 701/102; 701/103; 701/104

(58) Field of Classification Search ..... 123/295, 123/299, 301, 431, 1 A, 519, 300, 45 A, 487, 123/490, 599, 482, 478, 488, 497, 505; 701/101–105; 700/68; 73/114.6; *F02B 5/00*
See application file for complete search history.

(56) References Cited

U.S. PATENT DOCUMENTS

| | | | | |
|---|---|---|---|---|
| 4,537,065 | A * | 8/1985 | Ootsuka et al. | 73/114.18 |
| 4,766,863 | A | 8/1988 | Fujimori et al. | |
| 5,031,594 | A * | 7/1991 | Morikawa | 123/295 |
| 5,740,780 | A | 4/1998 | Shimizu et al. | |
| 5,791,314 | A | 8/1998 | Ito et al. | |
| 6,082,330 | A | 7/2000 | Alberter et al. | |
| 6,138,638 | A * | 10/2000 | Morikawa | 123/295 |
| 7,333,885 | B2 * | 2/2008 | Kakuya et al. | 701/102 |

FOREIGN PATENT DOCUMENTS

DE 10227279 A 1/2004

OTHER PUBLICATIONS

French Search Report dated Apr. 28, 2006 in French appln. No. 0505784.

* cited by examiner

*Primary Examiner*—Stephen K Cronin
*Assistant Examiner*—Keith Coleman
(74) *Attorney, Agent, or Firm*—Nicolas E. Seckel

(57) ABSTRACT

System for controlling the operation of a motor vehicle diesel engine in which the supply of fuel to the cylinders is controlled as a function of the pressure of a reference cylinder acquired and a predetermined desired fuel supply value for each cylinder, the supply of fuel to the reference cylinder is slaved to its desired supply value as a function of the pressure acquired, the drive shaft rotation speed generated by the displacement of the piston of the reference cylinder and the drive shaft rotation speed generated by the displacement of the piston of at least one other cylinder are acquired, and the supply of fuel to this at least one other cylinder is actuated as a function of the speeds acquired by slaving the drive shaft rotation speed related to the at least one other cylinder to the drive shaft rotation speed related to the reference cylinder.

17 Claims, 3 Drawing Sheets

SYSTEM FOR CONTROLLING THE OPERATION OF A DIESEL ENGINE OF A MOTOR VEHICLE

BACKGROUND TO THE INVENTION

The present invention relates to a system for controlling the operation of a diesel engine of a motor vehicle comprising means for supplying fuel to the cylinders thereof.

More especially, the present invention relates to a system comprising means for acquiring the pressure of a reference cylinder and means for controlling the supply means as a function of the pressure acquired and a predetermined desired fuel supply value for each cylinder.

Numerous systems for resetting the injection of a diesel engine of a motor vehicle are known in the prior art. The function of those systems is to bring about regularly and/or periodically during the life cycle of the engine a fresh adjustment of the injection of fuel into the cylinders thereof in order to correct the various drifts of its operation (such as, for example, the aging of its cylinders which brings about a change in their compression rate, in the permeability of their valves, etc.).

However, this type of system requires the installation of numerous additional sensors, especially a pressure sensor for each cylinder of the engine, and/or the use of a microprocessor having a large calculating capacity in order to calculate all of the data necessary for the regulation of the engine injection.

SUMMARY OF THE INVENTION

The object of the present invention is to solve the abovementioned problem by proposing a system for controlling the operation of a diesel engine of a motor vehicle, which system requires a reduced number of sensors and a reduced calculation capacity.

To that end, the invention relates to a system for controlling the operation of a diesel engine of a motor vehicle comprising means for supplying fuel to the cylinders thereof, the system comprising means for acquiring the pressure of a reference cylinder and means for controlling the supply means as a function of the pressure acquired and a predetermined desired fuel supply value for each cylinder, wherein the control means comprise:

- slaving means suitable for slaving the supply of fuel to the reference cylinder to its desired supply value as a function of the pressure acquired;
- means for acquiring the drive shaft rotation speed generated by the displacement of the piston of the reference cylinder and the drive shaft rotation speed generated by the displacement of the piston of at least one other cylinder; and
- actuating means suitable for actuating the supply of fuel to this at least one other cylinder as a function of the speeds acquired by slaving the drive shaft rotation speed generated by the displacement of the piston of this at least one other cylinder to the drive shaft rotation speed generated by the displacement of the piston of the reference cylinder.

According to other features, the system is wherein:

- the control means are suitable for controlling the flow rate of fuel injected into the cylinders by the supply means as a function of a desired fuel flow rate value for each cylinder, and in that the system comprises means for estimating the flow rate of fuel injected into the reference cylinder as a function of the pressure acquired therefrom;

- the slaving means comprise mapping means for correcting the desired flow rate value of the reference cylinder as a function of the difference between the desired flow rate value and the estimated flow rate;
- the supply means comprise common rail supply means, the system comprises means for acquiring the pressure of the common rail supply means, and the slaving means are capable of slaving the supply of the reference cylinder as a function of the pressure acquired from the common rail supply means;
- the means for acquiring the drive shaft rotation speed generated by the displacement of the piston of the reference cylinder and the drive shaft rotation speed generated by the displacement of the piston of the at least one other cylinder comprise means for acquiring the engine rotation speed and means for determining the drive shaft rotation speeds generated by the displacement of these pistons as a function of the speed acquired;
- the means for actuating the supply to the at least one other cylinder are capable of modifying the desired supply value thereof as a function of the difference between the drive shaft rotation speed generated by the displacement of the piston of the reference cylinder and the drive shaft rotation speed generated by the displacement of the piston of the at least one other cylinder;
- the means for actuating the supply to the at least one other cylinder comprise means for regulating speed cycle by cycle using cycle-by-cycle regulation of the drive shaft rotation speed generated by the displacement of the piston of the at least one other cylinder in accordance with the drive shaft rotation speed generated by the displacement of the piston of the reference cylinder; and
- the means for actuating the supply to the at least one other cylinder comprise self-adaptive mapping means capable of calculating a correction value for the supply to the at least one other cylinder as a function of the engine rotation speed and the drive torque.

The present invention will be better understood on reading the following description which is given purely by way of example and in relation to the appended drawings.

DESCRIPTION OF THE PREFERRED EMBODIMENTS

Figure 1:
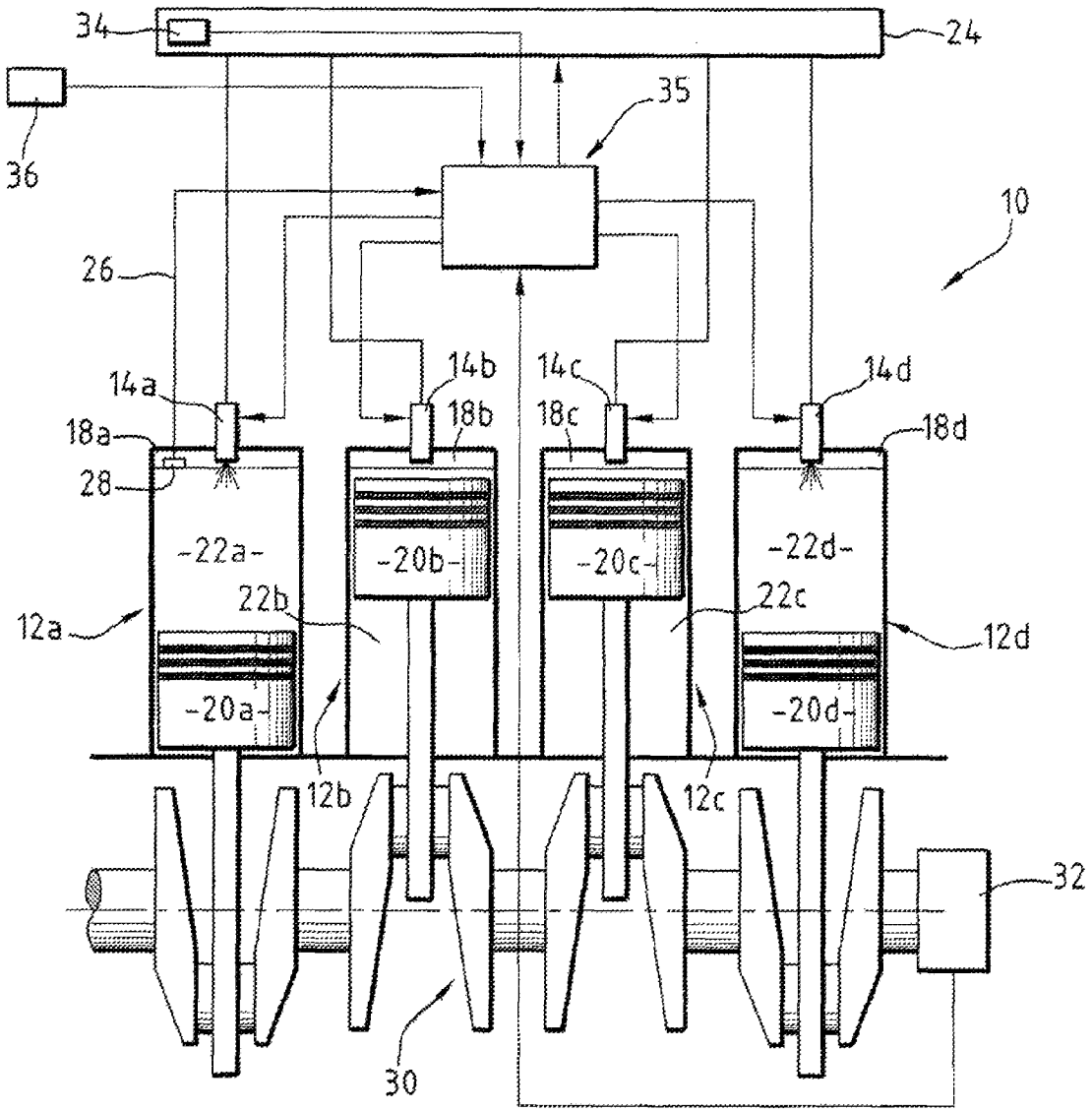
FIG. 1 is a schematic view of a system according to the invention associated with a diesel engine having a common supply rail.

FIG. 1 shows under the general reference 10 a diesel engine for a motor vehicle equipped, for example, with four cylinders 12*a*, 122*b*, 12*c*, 12*d*.

Each cylinder 12*a*, 12*b*, 12*c*, 12*d* of the engine 10 comprises an injector 14*a*, 14*b*, 14*c*, 14*d*, a cylinder head 18*a*, 18*b*, 18*c*, 18*d*, a piston 20*a*, 20*b*, 20*c*, 20*d* and a combustion chamber 22*a*, 22*b*, 22*c*, 22*d* delimited by the piston and the cylinder head The cylinder injector, contained in the cylinder head, is connected to a common supply rail 24 of the engine and is suitable for supplying the combustion chamber 22*a*, 22*b*, 22*c*, 22*d* of the cylinder with fuel in accordance with an injection strategy predetermined in accordance with, for example, at least one pilot injection and a main injection of fuel, as is known in the prior art.

A cylinder, for example the cylinder 12*a*, which is designated the "reference" cylinder in the description hereinafter, is also associated with an acquisition chain 26 for the pressure in the cylinder. This acquisition chain 26 comprises, for example, a deformation sensor 28 which has a piezoelectric element and which is inserted in the head 18*a* of the reference cylinder 12*a* or integrated in the glow plug (not shown) thereof, and which is capable of measuring deformations of the cylinder head 18*a* under the effect of pressure variations in the combustion chamber 22*a* of the cylinder 12*a*.

The pistons 20*a*, 20*b*, 20*c*, 20*d* are connected to a drive shaft 30 of the engine 10. The drive shaft 30 is associated with an acquisition chain 32 for the engine rotation speed, comprising, for example, a Hall effect sensor associated with a toothed wheel secured to the drive shaft.

An acquisition chain for the drive shaft angle is also associated with the drive shaft 30. This chain is, for example, merged with the speed acquisition chain 32, this chain being in a form suitable for acquiring these two variables, as is known per se in the prior art.

An acquisition chain 34 for the pressure in the common supply rail 24 is also arranged in the common supply rail 24 in order to measure the pressure therein, as is known per se in the prior art.

An acquisition chain 36 for the drive torque desired by the driver is also provided and comprises, for example, a sensor of the position of the vehicle's accelerator pedal, as is known per se in the prior art.

The acquisition chains 26, 32, 34, 36 for the pressure in the reference cylinder 12*a*, the engine speed, the drive shaft angle, the pressure in the common supply rail and the desired drive torque are connected to a data processing and control unit 38. The unit 38 is suitable for actuating the operation of the engine as a function of the measurements delivered by the chains and, in particular, for correcting the fuel injection drifts in the cylinders.

The control unit 38 is connected to the injectors 14*a*, 14*b*, 14*c*, 14*d* of the cylinders and to the common supply rail 24 and is suitable for actuating different operating parameters thereof, such as, for example, the flow rate of the fuel injected into the cylinders 12*a*, 12*b*, 12*c*, 12*d* by the injectors 14*a*, 14*b*, 14*c*, 14*d*.

Figure 2:
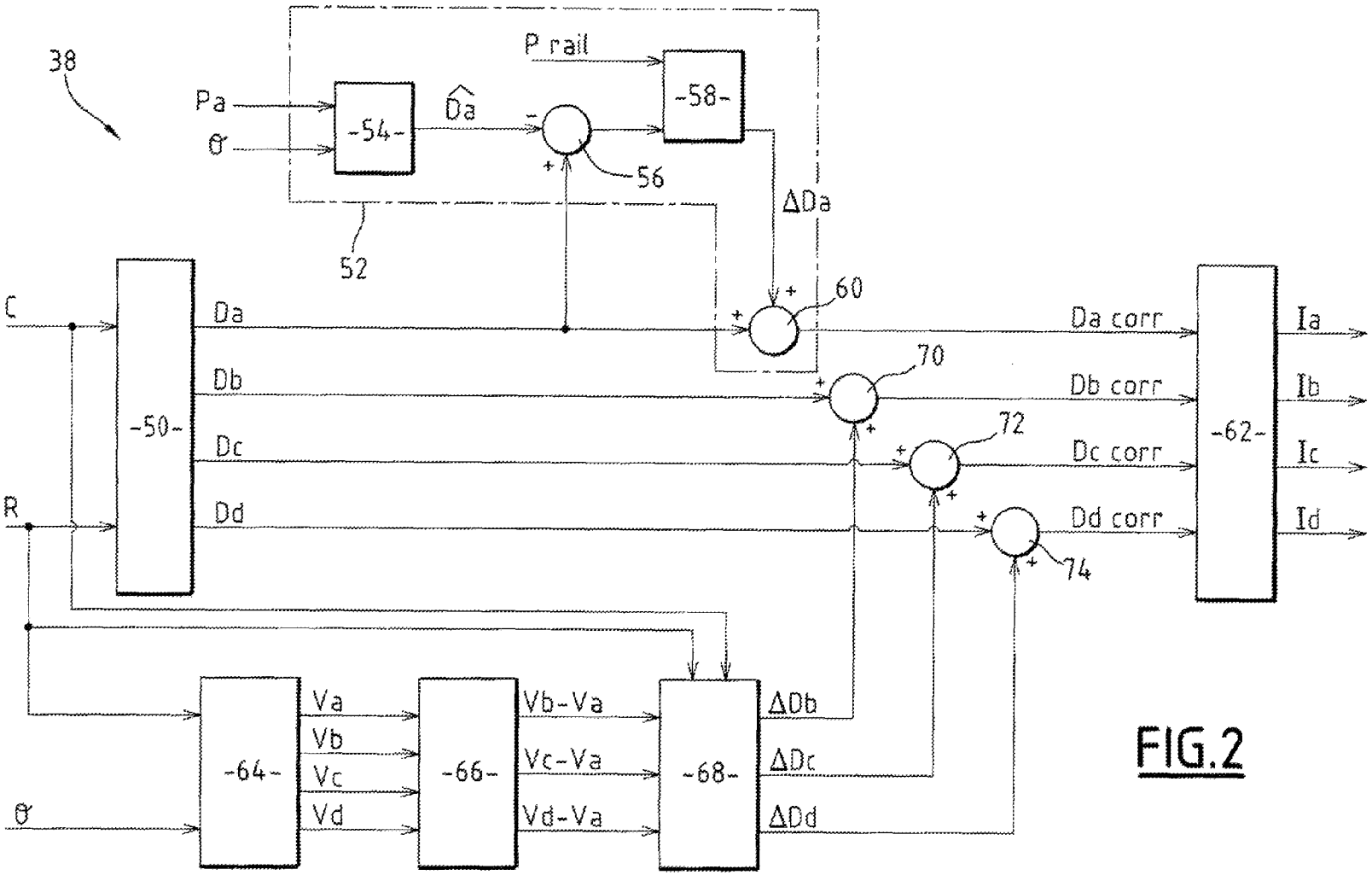
FIG. 2 is a schematic view of a control unit forming part of the system of FIG. 1.

FIG. 2 is a schematic view of the control unit 38.

The unit 38 comprises first mapping means 50 connected to receive the speed R and the torque C acquired and capable of evaluating, for those two values, a predetermined map of desired flow rate values as a function of pairs of values of engine speed and drive torque, as is known per se in the prior art. The first means 50 deliver as an output a desired flow rate value Da, Db, Dc, Dd for each cylinder 12*a*, 12*b*, 12*c*, 12*d* of the engine 10.

The unit 38 also comprises slaving means 52 suitable for staving the fuel flow rate in the reference cylinder 12*a* to its corresponding desired flow rate value Da as a function of the pressure Pa acquired therefrom.

These slaving means 52 comprise a module 54 for estimating the rate of injection into the reference cylinder 12*a* as a function of the pressure Pa acquired and the drive shaft angle θ acquired over a predetermined range of angles.

The module 54 is connected to a subtractor 56 which is also connected to the first mapping means 50. The subtractor 56 forms the difference between the desired flow rate value Da delivered by the means 50 and the flow rate $\hat{D}a$ estimated by the means 52 and delivers this difference to second correction mapping means 58.

The second means 58 memorize this difference and determine a resetting value ΔDa for the desired flow rate value Da of the reference cylinder 12*a* calculated by the first mapping means 50.

The estimation of the fuel injection rate into the reference cylinder as a function of the pressure therein and also the calculation of the resetting value ΔDa for the desired flow rate value Da are, for example, explained in detail in French patent application FR 2 838 775 in the name of the Applicant.

An adder 60 is connected to the first and second mapping means 50, 58 and adds the desired flow rate value Da to the resetting value ΔDa for Da in order to form a corrected desired flow rate value Dacorr for the reference cylinder 12*a*.

This corrected desired flow rate value Dacorr is delivered to control means 62 capable of actuating the injectors 14*a*, 14*b*, 14*c*, 14*d* as a function of the desired flow rate values which they receive, as is known per se in the prior art.

The value ΔDa is determined in such a manner that the application of the corrected desired flow rate value Dacorr, as a desired value effective for the reference cylinder 12*a*, results in the real flow rate of fuel injected into that cylinder being substantially equal to the desired flow rate value Da initially determined by the first mapping means 50.

The control unit 38 also comprises means 64 connected to receive the engine speed R and the drive shaft angle θ acquired. The means 64 calculate as a function thereof, and for each cylinder 12*a*, 12*b*, 12*c*, 12*d* of the engine, the drive shaft rotation speed Va, Vb, Vc, Vd generated by the displacement of the piston of the cylinders, referred to hereinafter by the terms "rotation speed associated with the cylinder".

For example, the means 64 calculate the rotation speed associated with the cylinder by averaging the engine speed R acquired over a predetermined range of angles of the cylinder cycle. Preferably, this range of angles is contained in the expansion phase of the cylinder cycle and corresponds, for example, to the range of angles separating the top dead centre of the cylinder cycle from the top dead centre of the cylinder cycle in which the next combustion takes place.

The means 64 are connected to means 66 for calculating the differences in the speeds Vi−Va, where Vi denotes the rotation speed associated with a cylinder other than the reference cylinder 12*a*, that is to say, the rotation speed Vb, Vc and Vd associated with the cylinders 12*b*, 12*c* and 12*d*, respectively.

These differences in rotation speeds Vi−Va are delivered by the calculation means 66 to means 68 for regulating the rotation speed. The means 68 are capable of determining resetting values ΔDb , ΔDc and ΔDd for the desired flow rate values Db, Dc and Dd, respectively, in order to regulate the rotation speeds associated with the cylinders 12*b*, 12*c* and 12*d* in accordance with the rotation speed associated with the reference cylinder 12*a*, as will be explained in more detail hereinafter.

The resetting values ΔDb, ΔDc, ΔDd for the desired flow rate values Db, Dc, Dd are delivered to adders 70, 72 and 74, respectively. The adders 70, 72, 74 are also connected to the first mapping means 50 and add the desired flow rate values Db, Dc, Dd calculated by the means 50 to the resetting values ΔDb, ΔDc, ΔDd, respectively, in order to generate corrected desired flow rate values Dbcorr, Dccorr, Ddcorr for the cylinders 12*b*, 12*c*, 12*d*.

The corrected desired flow rate values Dbcorr, Dccorr, Ddcorr are delivered to the control means 62 which actuate the injectors 14*b*, 14*c*, 14*d* of the cylinders 12*b*, 12*c*, 12*d* as a function of those values.

Each resetting value ΔDb, ΔDc, ΔDd is determined in such a manner that the application of the corresponding corrected desired flow rate value Dbcorr, Dccorr, Ddcorr as a desired value effective for the cylinder concerned results in the rotation speed associated with this cylinder being substantially equal to that associated with the reference cylinder 12*a*, thus cancelling the corresponding difference in speeds Vi−Va.

Figure 3:
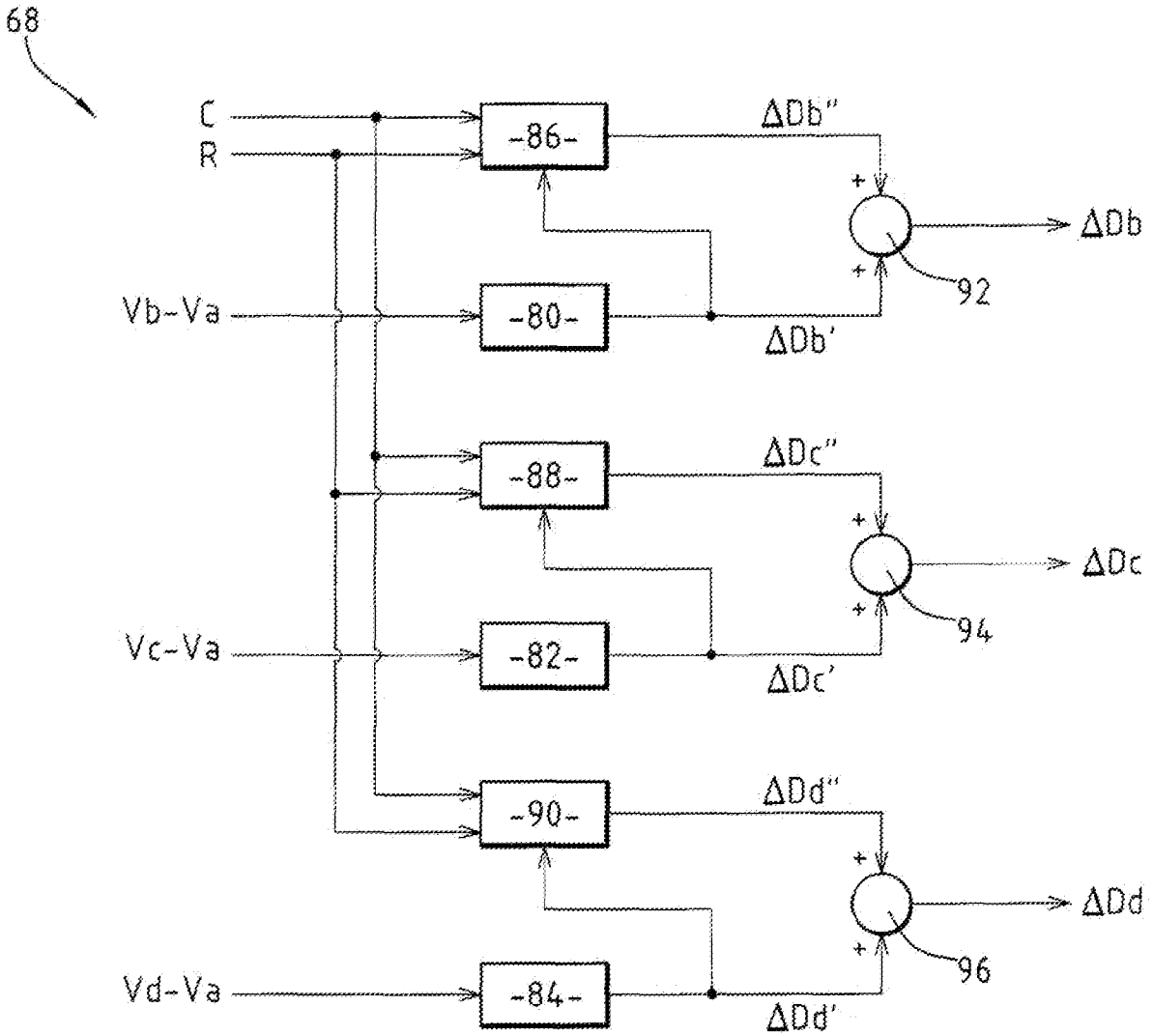
FIG. 3 is a schematic view of speed regulating means forming part of the control unit of FIG. 2.

An embodiment of the means 68 for regulating the rotation speed is illustrated schematically in FIG. 3.

In this embodiment, the means 68 comprise a rapid loop for rotation speed regulation and a slow loop for rotation speed regulation.

The rapid regulation loop comprises means 80, 82, 84 for regulating rotation speed cycle by cycle. These means 80, 82, 84 receive as an input the differences in rotation speeds Vi−Va and are capable of calculating, at each engine cycle, first resetting values ΔDb', ΔDc', ΔDd' for the flow rates Db, Dc and Dd, respectively. For that purpose, the means 80, 82, 84 use a predetermined law of regulation of the rotation speeds associated with the cylinders 12*b*, 12*c* and 12*d* in accordance with the rotation speed associated with the reference cylinder 12*a*, for example, in the form of a predetermined transfer function between each difference in rotation speeds Vi−Va and its first associated resetting value ΔDb', ΔDc', ΔDd'. These transfer functions are determined in a preliminary study. For example, the same transfer function is used to regulate all of the rotation speeds.

The slow regulation loop, which has slower dynamics than those of the rapid loop, comprises means 86, 88, 90 forming a so-called "self-adaptive" map for regulating rotation speed. The means 86, 88, 90 are connected to the means 80, 82, 84 for regulating rotation speed and are capable of memorizing the first resetting values ΔDb', ΔDc', ΔDd' delivered by the latter as a function of their location in the engine field defined by the drive torque and the speed. The means 86, 88, 90 are also connected to the acquisition chains for the speed R and the torque C.

These means 86, 88, 90 determine, as a function of the first resetting values ΔDb', ΔDc', ΔDd' memorized and the values of the speed R and the torque C received as an input, second resetting values ΔDb", ΔDc", ΔDd" for the flow rates Db, Dc, Dd, by evaluating respective predetermined maps of resetting flow rate values.

Finally, as shown in FIG. 3, adders 92, 94, 96 are connected to the means 80, 82, 84 for regulating rotation speed and to the mapping means 86, 88, 90.

The adders 80, 82, 84 are capable of adding the first resetting values ΔDb', ΔDc', ΔDd' to the second resetting values ΔDb", ΔDc", ΔDd", respectively, and of delivering the corresponding sums ΔDb'+ΔDb", ΔDc'+ΔDc", ΔDd'+ΔDd" to the adders 70, 72, 74 as resetting Values ΔDb, ΔDc, ΔDd for the flow rates Db, Dc, Dd.

What is claimed is:

1. A system for controlling the operation of a diesel engine of a motor vehicle comprising means for supplying fuel to the cylinders thereof, the system comprising means for measuring the actual pressure in a combustion chamber of a reference cylinder and means for controlling the supply means as a function of the pressure measured and a predetermined desired fuel supply value for each cylinder, wherein the control means includes:

slaving means for slaving the supply of fuel to the reference cylinder to its desired supply value as a function of the pressure measured;

means for acquiring the drive shaft rotation speed generated by the displacement of the piston of the reference cylinder and the drive shaft rotation speed generated by the displacement of the piston of at least one other cylinder; and actuating means for actuating the supply of fuel to this at least one other cylinder as a function of a difference between (i) the drive shaft rotation speed generated by the displacement of the piston of this at least one other cylinder and (ii) the drive shaft rotation speed generated by the displacement of the piston of the reference cylinder.

2. A system according to claim 1, wherein the control means are suitable for controlling the flow rate of fuel injected into the cylinders by the supply means as a function of a desired fuel flow rate value for each cylinder, and the system comprises means for estimating the flow rate of fuel injected into the reference cylinder as a function of the pressure measured therefrom.

3. A system according to claim 2, wherein the slaving means comprise mapping means for correcting the desired flow rate value of the reference cylinder as a function of the difference between the desired flow rate value and the estimated flow rate.

4. A system according to claim 1, wherein the supply means comprise common rail supply means, the system comprises means for acquiring the pressure of the common rail supply means, and the slaving means are for slaving the supply of the reference cylinder as a function of the pressure acquired from the common rail supply means.

5. A system for controlling the operation of a diesel engine of a motor vehicle comprising means for supplying fuel to the cylinders thereof, the system comprising means for measuring the actual pressure in a combustion chamber of a reference cylinder and means for controlling the supply means as a function of the pressure measured and a predetermined desired fuel supply value for each cylinder, wherein the control means includes:

slaving means suitable for slaving the supply of fuel to the reference cylinder to its desired supply value as a function of the pressure measured;

means for acquiring the drive shaft rotation speed generated by the displacement of the piston of the reference cylinder and the drive shaft rotation speed generated by the displacement of the piston of at least one other cylinder; and actuating means suitable for actuating the supply of fuel to this at least one other cylinder as a function of the speeds acquired by slaving the drive shaft rotation speed generated by the displacement of the piston of this at least one other cylinder to the drive shaft rotation speed generated by the displacement of the piston of the reference cylinder, wherein the means for acquiring the drive shaft rotation speed generated by the displacement of the piston of the reference cylinder and the drive shaft rotation speed generated by the displacement of the piston of the at least one other cylinder comprise means for acquiring the engine rotation speed and means for determining the drive shaft rotation speeds generated by the displacement of these pistons as a function of the speed acquired, wherein the means for actuating the supply to the at least one other cylinder are capable of modifying the desired supply value thereof as a function of the difference between the drive shaft rotation speed generated by the displacement of the piston of the reference cylinder and the drive shaft rotation speed generated by the displacement of the piston of the at least one other cylinder, and wherein the means for actuating the supply to the at least one other cylinder comprise means for regulating speed cycle by cycle using cycle-by-cycle regulation of the drive shaft rotation speed generated by the displacement of the piston of the at least one other cylinder in accordance with the drive shaft rotation speed generated by the displacement of the piston of the reference cylinder.

6. A system according to claim 1, wherein the means for actuating the supply to the at least one other cylinder comprise self-adaptive mapping means capable of calculating a correction value for the supply to the at least one other cylinder as a function of the engine rotation speed and the drive torque.

7. A system according to claim 1, wherein the means for measuring the actual pressure comprise a pressure sensor that measures the effect of pressure variations in the combustion chamber.

8. A system according to claim 7, wherein the pressure sensor is a deformation sensor which has a piezoelectric element.

9. A method of controlling the operation of a diesel engine of a motor vehicle comprising:

supplying fuel to the cylinders thereof, measuring the actual pressure in a combustion chamber of a reference cylinder, and controlling the fuel supply as a function of the pressure measured and a predetermined desired fuel supply value for each cylinder, including:

slaving the supply of fuel to the reference cylinder to its desired supply value as a function of the pressure measured;

acquiring the drive shaft rotation speed generated by the displacement of the piston of the reference cylinder and the drive shaft rotation speed generated by the displacement of the piston of at least one other cylinder; and actuating the supply of fuel to this at least one other cylinder as a function of a difference between (i) the drive shaft rotation speed generated by the displacement of the piston of this at least one other cylinder and (ii) the drive shaft rotation speed generated by the displacement of the piston of the reference cylinder.

10. A method according to claim 9, wherein the controlling step includes controlling the flow rate of fuel injected into the cylinders as a function of a desired fuel flow rate value for each cylinder, and the method comprises estimating the flow rate of fuel injected into the reference cylinder as a function of the pressure measured therefrom.

11. A method according to claim 10, wherein the slaving step comprise correcting the desired flow rate value of the reference cylinder as a function of the difference between the desired flow rate value and the estimated flow rate.

12. A method according to claim 9, wherein fuel is supplied using a common rail, and the method comprises acquiring the pressure of the common rail, and slaving the supply of the reference cylinder as a function of the pressure acquired from the common rail.

13. A method of controlling the operation of a diesel engine of a motor vehicle comprising:

supplying fuel to the cylinders thereof, measuring the actual pressure in a combustion chamber of a reference cylinder, and controlling the fuel supply as a function of the pressure measured and a predetermined desired fuel supply value for each cylinder, including:

slaving the supply of fuel to the reference cylinder to its desired supply value as a function of the pressure measured;

acquiring the drive shaft rotation speed generated by the displacement of the piston of the reference cylinder and the drive shaft rotation speed generated by the displacement of the piston of at least one other cylinder; and actuating the supply of fuel to this at least one other cylinder as a function of the speeds acquired by slaving the drive shaft rotation speed generated by the displacement of the piston of this at least one other cylinder to the drive shaft rotation speed generated by the displacement of the piston of the reference cylinder, wherein the step of acquiring the drive shaft rotation speed generated by the displacement of the piston of the reference cylinder and the drive shaft rotation speed generated by the displacement of the piston of the at least one other cylinder comprises acquiring the engine rotation speed and determining the drive shaft rotation speeds generated by the displacement of these pistons as a function of the speed acquired, wherein the step of actuating the supply to the at least one other cylinder includes modifying the desired supply value thereof as a function of the difference between the drive shaft rotation speed generated by the displacement of the piston of the reference cylinder and the drive shaft rotation speed generated by the displacement of the piston of the at least one other cylinder, wherein the step of actuating the supply to the at least one other cylinder comprises regulating speed cycle by cycle using cycle-by-cycle regulation of the drive shaft rotation speed generated by the displacement of the piston of the at least one other cylinder in accordance with the drive shaft rotation speed generated by the displacement of the piston of the reference cylinder.

14. A method according to claim 9, wherein the step of actuating the supply to the at least one other cylinder comprises using self-adaptive mapping to calculate a correction value for the supply to the at least one other cylinder as a function of the engine rotation speed and the drive torque.

15. A method according to claim 9, wherein the step of measuring the actual pressure comprises using a pressure sensor to measure the effect of pressure variations in the combustion chamber.

16. A system according to claim 15, wherein the pressure sensor is a deformation sensor which has a piezoelectric element.

17. A system according to claim 1, wherein a pressure sensor is not present in a combustion chamber of any cylinder other than the reference cylinder.

* * * * *